United States Patent [19]

Myklebust et al.

[11] Patent Number: 4,750,846

[45] Date of Patent: Jun. 14, 1988

[54] CONTAINER FOR TRANSPORT AND STORAGE OF BULK MATERIAL

[75] Inventors: Eirik Myklebust; Bjarne Omdal, both of Porsgrunn, Norway

[73] Assignee: Norsk Hydro a.s., Oslo, Norway

[21] Appl. No.: 1,726

[22] Filed: Jan. 7, 1987

[30] Foreign Application Priority Data

Jan. 8, 1986 [NO] Norway ..... 860041

[51] Int. Cl.[4] ..... B65D 33/01; B65D 33/08

[52] U.S. Cl. ..... 383/8; 383/101; 383/109

[58] Field of Search ..... 383/8, 100, 101, 102, 383/107, 109, 32; 220/404

[56] References Cited

U.S. PATENT DOCUMENTS

| | | | |
|---|---|---|---|
| 3,085,737 | 4/1963 | Horton | 383/101 |
| 3,394,871 | 7/1968 | Williams et al. | 383/100 |
| 3,961,655 | 6/1976 | Nattrass et al. | 383/109 |
| 4,132,347 | 1/1979 | Saito | 383/109 |
| 4,223,709 | 9/1980 | Myklebust | 383/8 |
| 4,470,153 | 9/1984 | Kenan | 383/101 |

FOREIGN PATENT DOCUMENTS

| | | | |
|---|---|---|---|
| 1389888 | 1/1965 | France | 383/100 |
| 2224356 | 10/1974 | France | 383/100 |
| 541702 | 4/1956 | Italy | 383/101 |

OTHER PUBLICATIONS

Wall Street Journal, Eastern Edition, Mar. 12, 1964, p. 6.

*Primary Examiner*—Stephen Marcus

*Attorney, Agent, or Firm*—Wenderoth, Lind & Ponack

[57] ABSTRACT

A container includes an outer load carrying bag or container with lifting loop(s) and at least one filling opening, and a liner having two sides closed with welds spaced from the inner side edges to form skirts which allow air in the liner to escape through openings between the welds. The welds are interrupted and overlapped by a distance a, preferably such that $0\% < a < 50\%$ of the liner's total side length. The liner is placed in the outer container such that the welded seams with the skirts are parallel to the vertical axis of the container and are fastened to side seams thereof. The liner has an opening for filling of bulk material, and it may have a gusset which preferably has a height of up to $\frac{1}{4}$ of the flat width of the liner between the welds.

10 Claims, 2 Drawing Sheets

CONTAINER FOR TRANSPORT AND STORAGE OF BULK MATERIAL

BACKGROUND OF THE INVENTION

The present invention relates to a container for transport and storage of bulk material and including an outer load carrying container with lifting loops and at least one opening for filling, and a liner. The invention also relates to a special liner to be used with such container.

For most types of bulk materials for which the container is used, the most practical and economical solution has proved to be an outer load carrying container and a liner whose primary function is to protect the bulk material against moisture and contamination. However, air entrapped in the liner can cause stability problems when containers are stacked during storage. Such instability occurs when containers are stacked in tiers. Any upper container will then float on the air cushion of the container underneath. Such floating effect can cause the stacked containers to topple. As such containers often are stacked four to five tiers high, entrapped air in the liners can be very dangerous. Of course, this danger can be avoided by not stacking the containers, but this will increase the required storage area and make the use of the containers more expensive.

To solve this problem different methods have been tried. One method is to try to remove the air by suction from the liner after filling, and another method is to vibrate the container during filling to more densely pack the contents. Even a combination of such methods does not solve the stability problem when stacking containers in storage, as there still will be some air entrapped in the liners which can form air cushions.

A method of perforating liners or wall material is known from the 50 kg sack industry to obtain a stable pallet of 50 kg sacks. Entrapped air in the sack will bleed off through the perforation when the next sack is placed thereon. Palletized loads of 50 kg sacks are always covered with a plastic hood of some sort to avoid penetration of moisture through the perforations of the liners or wall material. To perforate the liners of flexible intermediate bulk containers eliminates instability when stacking containers in storage, but will require covering of the complete stack or each individual container to avoid moisture ingress. Thus, the solution of one problem creates a new one.

The correct positioning of the liner inside the container is important to limit the amount of air which can be trapped inside the liner. However, in practice it is found that during filling of bulk material into the container, problems may arise with the liner, even though it originally has been positioned correctly in the load carrying container. The liner may be displaced and crumpled so that the bulk material filled into the container makes it lopsided, thus forming air pockets which are not filled with bulk material during filling. After tying off the liner, bulk material may flow into the air pockets and the air then escapes to the top.

The securing of the liner position inside the container with adhesive tape at several positions will limit but not solve the problem of liner displacement and crumpling. With poor adhesive quality the tapes will come loose, and with high adhesive quality the tapes cause tearing of the liners. Different methods have been proposed in order to attach the liners to the outer bags as it has been difficult to achieve a centered, stable and correct positioning of the liner during the production of the container. A practical solution to this problem is shown in Norwegian patent No. 153,250 corresponding to EP application No. 84,113,352,0. Norwegian patent application No. 85, 2476 seeks to avoid distortion of the liner within the container by a special method for securing the liner to the load carrying container, where the liner is equipped with tabs to attach the liner to the outer load carrying container. The tabs as such are integral prolongations of the liner sides and are formed by equipping the liner with joints or seams spaced from the outer edges of the liner. As a further object is to provide a liner which can be completely waterproof and as no means are described or detailed as to how excess air can bleed off, such proposed solution does not solve the instability problem due to the air cushion formed by entrapped air when stacking containers in tiers. Thus, the above method fits into all other attempts to solve the problems in connection with the use of a liner. It has turned out that the known solutions have not been satisfactory and at best have solved only a few of the above mentioned problems.

SUMMARY OF THE INVENTION

An object of the present invention is to provide a container with a liner which can be placed in a load carrying container during production of the container and in such a way that even distribution of the bulk material is achieved during filling, that the liner may be filled to maximum capacity, that the liner will not create any problems during a discharging operation, that air inside the bag may escape easily, and that contamination by moisture is avoided.

A further object of the invention is to provide a liner that can be used for various load carrying containers, and with which deaeration of entrapped air easily is achieved.

After examining the known solutions referred to above as well as evaluating the various types of liners, the inventors decided that they should base their solutions on the regular type of liner, and then develop new solutions to the above problems.

A liner is usually produced from plastic sheeting such as polyethylene, and it may be formed from a continuous tube from which individual lengths are cut off, or from one single folded plastic sheet welded at least at two sides, or from at least two plastic sheets of equal size welded at least at three sides to form the liner.

The inventors then found that they could make a liner which solved the above problems. The liner could be made from a tube-shaped member where the two openings thereof could be closed, for instance, by welded seams placed a few centimeters inside the outer edges of the member. By this method there are obtained fastening devices or skirts along the full lengths of the liner and which are formed as integral parts of the liner. The fastening devices or skirts which thereby are formed could then be fastened to the side seams of the load carrying container. The liner thus produced has a completely closed top, and therefore a filling opening is made and the size of this opening can vary according to requirements. Further, it was decided that the most practical arrangement for the bottom of the liner was to form a gusset which preferably had a height of nearly $\frac{1}{4}$ of the flat width of the liner, i.e., between the above-mentioned lengthwise welds.

The lengthwise welds may be arranged as continuous welds from the bottom of the top of the sides of the liner or for instance as two parallel side seams spaced from each other. However, as mentioned above such seams will prevent the air in the liner from escaping during filling or storage once the filling opening has been tied off. It was now found that it is possible to solve such deaeration problem and at the same time to have a liner which prevents penetration of moisture. This is achieved by interrupting and overlapping the welding seams in such a way that an outer downwardly extending seam starts at the top of the liner and passes an inner upwardly extending seam to produce an overlapping distance (a) which can vary from a>0 to less than the full length of the liner. In this way the air inside the liner can escape between the two welded seams, and the overlapping seams will prevent moisture from entering the liner during storage.

BRIEF DESCRIPTION OF THE DRAWINGS

The invention and its use will be explained further in the following description with reference to the accompanying drawings, wherein.

DETAILED DESCRIPTION OF THE INVENTION

Figure 1:
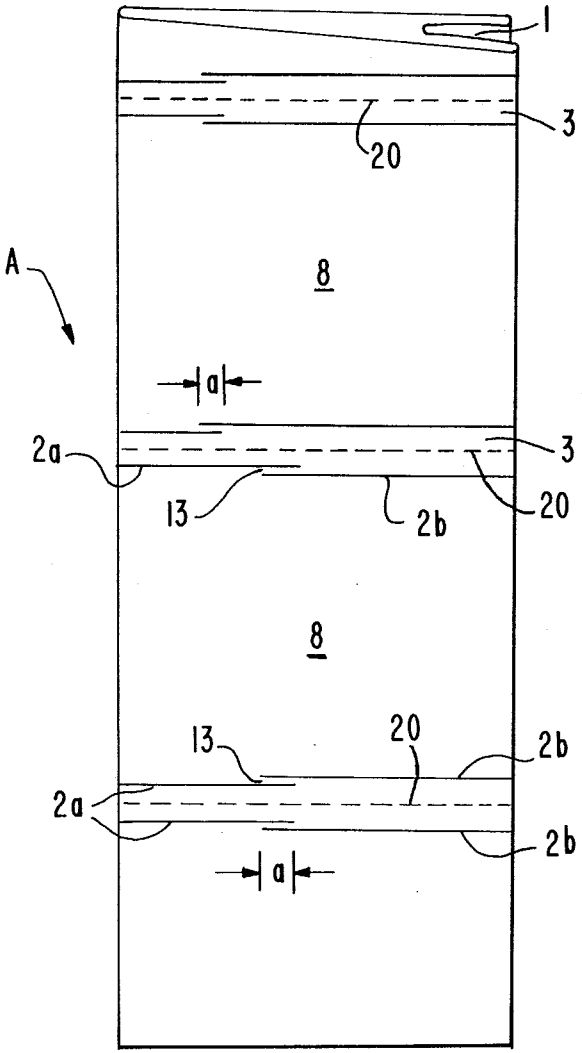
FIG. 1 is a schematic elevation view showing a tube-shaped member used for the production of a plurality of liners according to the invention.

FIG. 1 shows a tube-shaped member A which is cut transversely at 20 to form a number of pieces of material 8 from which liners are produced. Parallel welds 2*a*,2*b* are formed parallel to the cuts 20 in a manner to overlap in such a way as to allow air to escape, but at the same time to prevent water from entering. Each such deaeration arrangement forms a bleed opening 13 between the respective inner weld 2*b* and the outer weld 2*a*. FIG. 1 also shows that the bleed openings 13 formed by the welded, overlapping seams 2*a*, 2*b* may be placed high up on the sides (to the left in FIG. 1) or lower down on the sides (to the right in FIG. 1) of the respective liner. However, the best arrangement is to place the bleed opening 13 as far up on the sides of the liner as possible, due to lower pressure on the welds at such locations. The length (a) of overlap of each pair of welds 2*a*, 2*b* to prevent ingress of moisture may vary.

The liner of the invention also may be formed from one folded sheet or two equal sized sheets of plastic which are welded together to form the liner.

Figure 2:
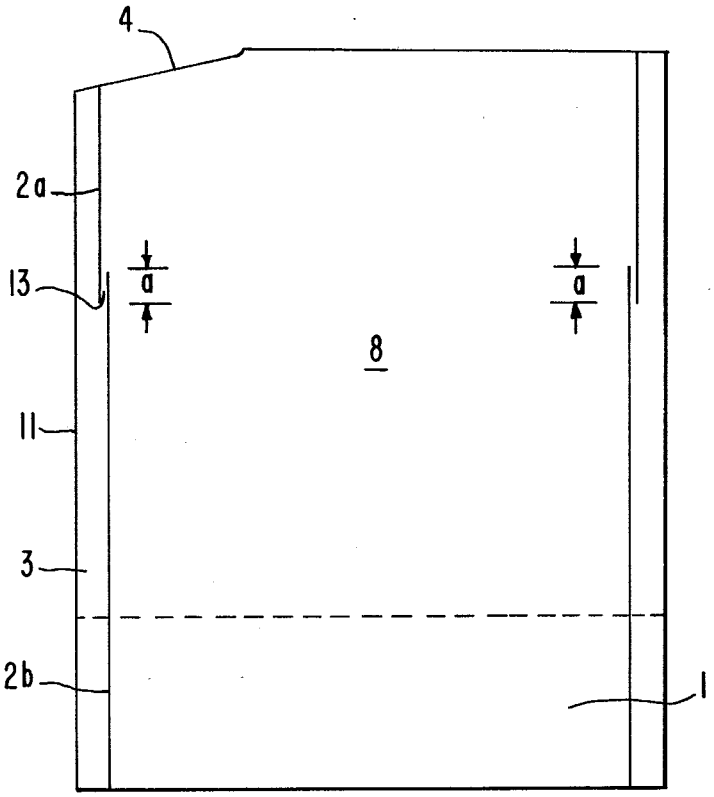
FIG. 2 is an elevation view of one liner formed from the arrangement of FIG. 1 according to the invention.

FIG. 2 shows a liner made of a piece of material 8 from the arrangement of FIG. 1, with pairs of welds 2*a*, 2*b* closing the two open ends of the piece of material 8 and forming skirts 3 between such welds and the respective outer edges 11 of the piece of material 8. FIG. 2 is rotated 90° C. to the right relative to the orientation of FIG. 1 and an incision 4 in the upper part of the liner may be cut in several ways and placed where required in the upper part of the liner to form a filling opening. A gusset 1, also shown in FIG. 1, is formed and enables the liner to have an almost rectangular bottom when filled with bulk material. The bleed openings 13 are shown adjacent the upper part of the liner. The invention is not limited to liners with bottoms having gussets.

Figure 3A:
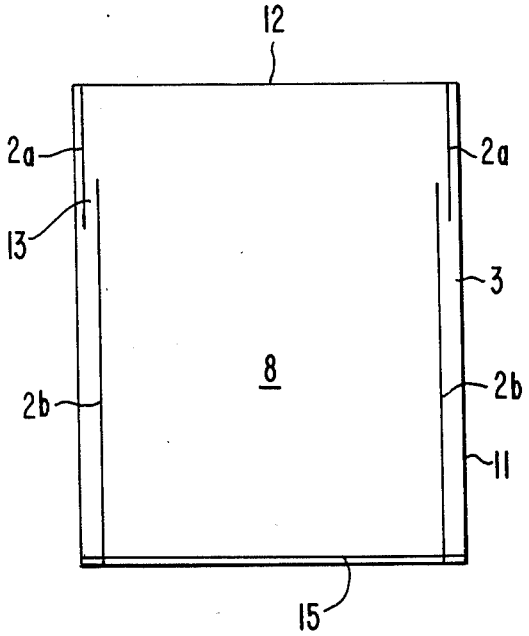
FIG. 3*a* and FIG. 3*b* are views similar to FIG. 2 but of other embodiments of the liner according to the invention.
Figure 3B:
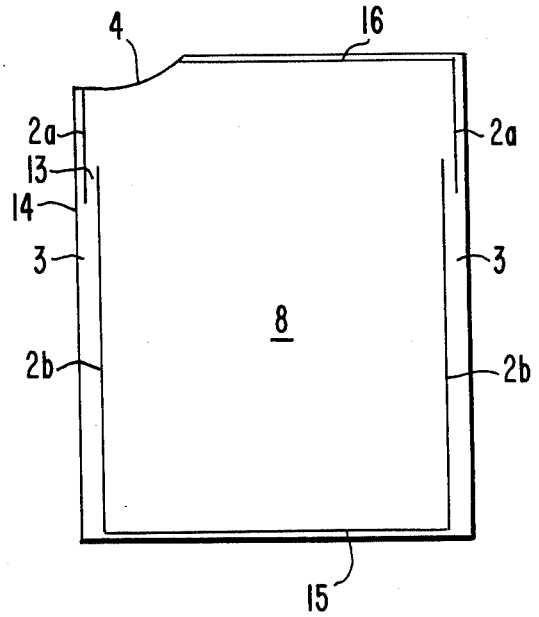

FIG. 3*a* shows a flattened piece of material 8 with two open side edges 11 and two parallel pairs of overlapping welds 2*a*, 2*b* spaced from respective side edges 11. The material between each pair of welds 2*a*, 2*b* and the respective side edge 11 forms a piece or a skirt 3 for fastening, e.g. sewing, the liner to a load carrying container. A bottom weld 15 is formed between side welds for closing the bottom of the liner. The liner thereby has a completely open top 12 which can serve as a filling opening opposite to the closed bottom 15. Alternatively, the top may be closed by a weld 16, and a filling opening can be formed by an incision 4, as shown in FIG. 3*b*. The piece of material 8 forming the liner further may be folded adjacent the top 12. Then the piece of material will be closed at all sides. Then the piece of material will be closed at all sides, and to open the liner it is necessary to make an incision as shown in FIG. 3*b*.

FIG. 3*b* shows a liner made from a tube-shaped member welded at 15,16 to close the bottom and top and having discontinuous lengthwise welds 2*a*, 2*b* according to the invention at each side spaced from edge folds 14 to form skirts 3. In this embodiment, the edge folds 14 will tend to prevent escape of air from skirts 3. In this special case the folds 14 outside the welds 2*a*, 2*b* will have to be opened, e.g., by an incision in the same, to let out entrapped air. Alternatively the welds (15 and/or 16) must stop at the welds 2*a*,2*b*. At the upper part of the liner is an incision 4 which may be cut in different ways and placed where required to form a filling opening.

Figure 4:
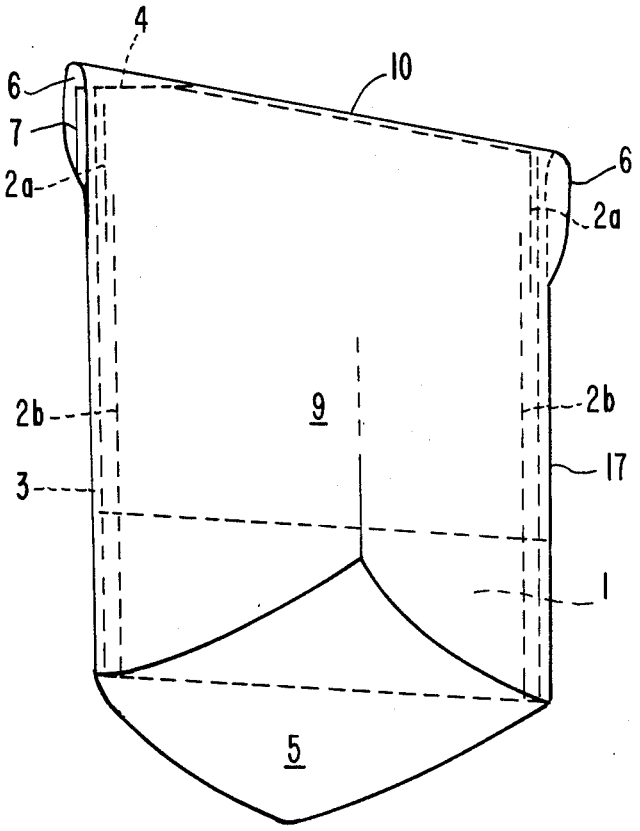
FIG. 4 is a perspective view of a container including the liner within a load carrying outer bag according to the invention.

FIG. 4 shows a container according to the invention with a load carrying bag or container 9 with lifting loop(s) 10. Openings 6 may be used as filling openings, and the upper part 7 of the liner with the opening 4 can be pulled out through one opening 6 during filling of a bulk material. The container 9 may be made of a flat piece of material which is folded together and joined at the sides 17 by side seams to which the skirts 3 of the liner can be fastened. The liner includes a gusset 1 indicated by two broken lines at the bottom of the liner, which means that FIG. 4 shows the container before filling with bulk material. After filling, the gusset will enable the bottom of the liner to have substantially the same shape as the bottom 5 of the container 9.

The present invention provides a liner that may be used inside several types of flexible, load carrying containers. The principle of producing a liner having bleed openings 13 in welds may be obtained in several ways without deviating from the inventive idea. For practical reasons, however, it has been found that the described arrangements are most appropriate.

As described above, when forming the bleed opening 13 between the two welded seams 2*a*, 2*b*, the distance between the lengthwise joint and the outer edge 11,14 must be sufficient to form a skirt 3 for fastening to the outer container side seams. In containers without side seams this distance can be reduced to nil, in which case the positioning of the liner must be done as known per se, for instance as in Norwegian patent No. 153,250.

The container according to the invention has a liner which can be placed in an exact position in the load carrying container, and this ensures a systematic filling operation with even distribution of the bulk material in the container and maximum utilization of the capacity of the liner. The liner is not damaged during the filling of the bulk material nor does it create any problems during discharge. In addition, a container according to the invention can be produced in a more expedient manner, while ensuring correct positioning and permanent fastening of the liner and excellent deaeration of the container when stacked.

A further advantage is the fact that moisture cannot get into the bulk material in the liner as easily as is the case with other types of liners. The top part of the liner is also that part which is most exposed to intrusion of moisture. According to the invention an exceptionally tight liner is obtained, because only small bleed openings are made in the side welds.

We claim:

1. In a container assembly for the transportation and storge of bulk material and including an outer load-carrying container having lifting loops and at least one filling opening and a liner positioned within said container for receiving the bulk material and to protect the bulk material from contamination and moisture, the improvement wherein said liner comprises:

a member having a closed bottom and two opposite vertically extending side edges;

means for allowing escape of air from within said member during filling thereof and for preventing moisture from entering said member, said means comprising, at each side of said member and spaced inwardly from said respective side edge thereof, a joint formed by first and second parallel substantially vertically extending seals, said first seal extending downwardly from a top portion of said member to a position spaced from said bottom thereof, and said second seal extending upwardly from said bottom of said member to a position spaced from the top thereof, and said first and second seals overlapping over a portion of the vertical lengths thereof and defining a bleed opening through which air can escape from within said member; and the material of said member between each said joint and the respective said side edge including means for attaching said liner to said container.

2. The improvement claimed in claim 1, wherein said member is formed of plastic material, and said first and second seals of each said joint comprise welds formed in said plastic material.

3. The improvement claimed in claim 1, wherein said first seal of each said joint is located closer to said respective side edge of said member than is said respective second seal.

4. The improvement claimed in claim 1, wherein said first and second seals of each said joint overlap by a distance equal to between 0–50% of the vertical height of said member.

5. The improvement claimed in claim 1, wherein said closed bottom of said member includes a gusset having a height equal to approximately one-fourth the horizontal distance between said joints when said liner is in a flattened condition.

6. The improvement claimed in claim 1, wherein said container has side seams, and the distance between each said joint and the respective said side edge is sufficient to enable said material therebetween to be attached to the respective said side seams of said container.

7. The improvement claimed in claim 1, wherein said member has a closed top with a portion thereof removed to form an opening through which bulk material may be filled into said liner from said filling opening of said container.

8. The improvement claimed in claim 1, wherein said member is formed from a cut-away length portion of a continuous tubular member, and said joints are formed to extend transverse to the longitudinal dimension of the tubular member across open ends of said cut-away length portion.

9. The improvement claimed in claim 1, wherein said member is formed from a single folded sheet member, and said joints are formed along opposite sides of said folded sheet member.

10. The improvememt claimed in claim 1, wherein said member is formed from two equal size sheets joined along at least three sides to form said closed bottom and said joints.

* * * * *